United States Patent [19]

Pumphrey et al.

[11] 3,960,680

[45] June 1, 1976

[54] TREATMENT OF CATALYTIC ANODES

[75] Inventors: Nicholas William James Pumphrey; William Laurence Woods, both of Runcorn, England

[73] Assignee: Imperial Chemical Industries Limited, Millbank, England

[22] Filed: Apr. 18, 1974

[21] Appl. No.: 462,116

[30] Foreign Application Priority Data

Apr. 25, 1973 United Kingdom ..... 19574/73

[52] U.S. Cl. ..... 204/98; 204/128; 204/129; 134/3

[51] Int. Cl.[2] ..... B01D 3/00

[58] Field of Search ..... 134/3; 204/99, 98, 128; 252/413

[56] References Cited

UNITED STATES PATENTS 2,704,281 3/1955 Appell ..... 252/413

OTHER PUBLICATIONS

"Handbook of Chem. & Physics" 1950, 32nd Ed., pp. 556–557.

Handbook of Chemistry & Physics, 32nd Ed., 1950, Chem. Rubber Publishing Co., pp. 580–581, 530, 531.

Handbook of Chemistry & Physics, 32nd Ed., 1950, Chem. Rubber Publishing Co., pp. 460–461.

*Primary Examiner*—R. L. Andrews

*Attorney, Agent, or Firm*—Cushman, Darby & Cushman

[57] ABSTRACT

A process for the removal of barium containing scale from anodes which comprises treating the anodes with sulphuric acid containing not more than 10 per cent by weight of water, eg by treating with concentrated sulphuric acid at ambient temperature. The invention is especially applicable to the removal of barium sulphate containing scale from oxide coated metal anodes of the type used in the electrolysis of aqueous alkali metal chloride (eg KCl) brines and wherein the brine use has been subjected to a purification stage which involves the removal of sulphate ions by the addition of barium chloride.

11 Claims, No Drawings

TREATMENT OF CATALYTIC ANODES

The present invention relates to a process for the removal of a barium containing scale from anodes used in the production of alkali metal hydroxides and chlorine by electrolysis of alkali metal chloride solutions.

The production of alkali metal hydroxide solutions, especially sodium hydroxide solutions and potassium hydroxide solutions, is usually carried out by electrolysing the corresponding alkali metal chloride solutions in either cathode cells or diaphragm cells. In such processes, typically a substantially saturated solution of the alkali metal chloride is introduced into the cell and subsequent electrolysis results in a reduction in concentration of the alkali metal chloride in the said solution corresponding to the amount of chlorine and alkali metal hydroxide (or amalgam) produced. The weakened solution of alkali metal chloride thus obtained, may, for example, be resaturated by the addition of alkali metal chloride and then returned to the cell. Impurities such as $Ca^{2+}$, $Mg^{2+}$ and $SO_4^{2-}$ ions, which are present in the added alkali metal chloride, are thereby introduced into the alkali metal solution and it is necessary to purify the saturated alkali metal chloride solution before returning it to the cell. The purification is generally carried out in successive stages comprising the addition of an alkali metal hydroxide solution to precipitate the $Mg^{2+}$ ions as magnesium hydroxide, the addition of barium chloride solution to precipitate the $SO_4^{2-}$ ions as barium sulphate, and the addition of an alkali metal carbonate to precipitate $Ca^{2+}$ ions and excess $Ba^{2+}$ ions as calcium carbonate and barium carbonate respectively. After filtration to remove the aforesaid precipitated solids, the purified alkali metal chloride solution is then returned to the cell.

In the course of electrolysis, deposition of a barium containing scale on the anodes can still occur to some extent even though purification of the resaturated alkali metal chloride solution has been carried out. This may arise from variations in the efficiency of the purificaton process which may occur from time to time, especially when there is a sudden variation in the levels of sulphate ions in the added alkali metal chloride. Furthermore, the degree of supersaturation with respect to barium sulphate in the alkali metal chloride solution will be expected to reduce during operation of the cell because of the reduction of pH which occurs. When using graphite anodes, the deposition of a barium sulphate presents little problem since build-up of scale is offset by the normal wear rate of the anodes. In recent years, however, there has been an increasing use of anodes made of a film-forming metal, for example titanium, and especially of anodes made of a film-forming metal and carrying an electrocatalytically active coating, for example a coating comprising one of more platinum group metals or their oxides, when coating is resistant to electrochemical attack but is active in transferring electrons between the electrolyte and the anode. The aforesaid metal anodes are considerably more resistant to wear than graphite anodes, and the gradual build-up of a barium containing scale on such anodes can reduce its current-passing efficiency. This can be partly offset by reducing the anode-cathode gap, but eventually the current passing efficiency may be reduced to such an extent that the anode has to be replaced. Removal of the barium containing scale, which is believed to be substantially barium sulphate, without at the same time removing the conductive coating, has proved to be extremely difficult in practice. Washing with water and with various organic solvents for example chlorinated hydrocarbons, followed by light brushing, has no effect on the barium containing scale. The use of various reagents, for example, 'Decon' (a cleaning product of Medical Pharmaceutical Products Limited) and ethylenediamine tetra-acetic acid, in conjunction with vibrating the anode ultrasonically for a period of about 30 minutes, results in partial removal of the scale, but also removes part of the conductive coating. The use of a concentrated solution of ethylenediamine tetra-acetic acid, and of a range of mineral acids, for example dilute phosphoric acid, hydrochloric acid (dilute and concentrated), dilute sulphuric acid and dilute nitric acid has also been found to be ineffective for removing the coating, even when the treatment has been carried out at an elevated temperature.

We have surprisingly found that the barium containing scale may be readily and substantially completely removed from an anode by treating with a concentrated sulphuric acid and without the necessity of using hot conditions and with no apparent damage to the anode.

According to the present invention we provide a process for removing a barium containing scale from an anode which comprises treating the said anode with sulphuric acid containing not more than 10 percent by weight of water.

A range of aqueous solutions of sulphuric acid containing up to 100 percent by weight of $H_2SO_4$ may be used, and also fuming sulphuric acid or oleum, but it is convenient to use concentrated sulphuric acids containing 94 to 98 percent by weight of $H_2SO_4$ and preferably commercial concentrated sulphuric acid of nominal 98% strength.

The treatment with sulphuric acid may conveniently be carried out at substantially ambient temperature.

The removal of scale may be carried out by immersing the anode to be treated in the sulphuric acid at ambient temperature for a short period. A period of 10 to 30 minutes, for example 15 minutes, is generally sufficient to remove substantially all the barium containing scale, although longer periods may be used without any detrimental effect to anodes having conductive coatings.

It is believed that the treatment effects the removal of a scale containing substantially barium sulphate by forming the acid barium sulphate ($Ba(HSO_4)_2$), which is soluble under the conditions of the treatment.

The process according to the invention is applicable to the removal of a barium containing scale from anodes used in any cells in which there is a purificaton stage involving the removal of $SO_4^{2-}$ ions from the alkali metal chloride solution by the addition of barium chloride. The process is, however, especially applicable to resaturation processes since this involves the addition of a solid alkali metal chloride which is conveniently in the form of the naturally occurring salt. The process is especially applicable to the treatment of anodes used in the electrolysis of aqueous potassium chloride, for example in a mercury cell, since a resaturation stage is included to avoid loss of relatively expensive potassium chloride.

The process is preferably applied to the removal of a barium-containing scale from anodes made of a film-forming metal, and especially to anodes made of a film-forming metal and carrying an electrocatalytically active coating.

By the term "film-forming metal" we mean one of the metals titanium, zirconium, niobium, tantalum and tungsten or alloys thereof.

The electrocatalytically active material of the conductive coating suitably comprises at least one platinum group metal or an oxide thereof. By the term 'platinum metal' is meant one of the metals platinum, rhodium, iridium, ruthenium, osmium and palladium. Ruthenium oxide is a preferred active material. The electrocatalytically active coating preferably comprises at least one platinum group metal or an oxide thereof and an oxide of a film-forming metal, for example titanium dioxide.

The invention is illustrated but not limited by the following Example.

EXAMPLE

The anodes to be treated each consisted of a foraminate structure comprising a plurality of titanium blades coated with ruthenium dioxide/titanium dioxide (initial loading 0.95 g $RuO_2$/anode). The anodes had been used in a mercury cathode cell for the production of potassium hydroxide and had been removed when it became no longer possible to adjust the anode-cathode gap to give the correct voltage factor.

The blades of each anode were found to be covered with a white deposit, which was shown by X-ray fluorscence spectroscopy to contain barium as a major constituent, and which was shown by X-ray diffraction to contain barium sulphate as the major crystalline component.

Each anode was dipped into a bath containing concentrated sulphuric acid (98% $H_2SO_4$) at 18°C, the volume of sulphuric acid being just sufficient to cover the blades. After a period of 15 minutes, the anode was removed. The anode was washed with water and was found by inspection to be substantially free from the white deposit. (Any white solid remaining was in fact very loosely held and could be easily rubbed off). The ruthenium dioxide/titanium dioxide coating appeared undamaged and this was confirmed by X-ray fluoresence which showed that the ruthenium dioxide content was 0.92 g/anode.

Analysis of the sulphuric acid solution after treatment of an anode showed that it contained less than 1 ppm ruthenium and less than 1 $\mu$g/ml of titanium. After treatment, the overvoltage of a sample cut from a cleaned anode was measured (area 0.5 sq. cm. at 10 kA/m$^2$) and was found to be 80 mV.

What we claim is:

1. A process for removing a barium containing scale from an anode which comprises a film-forming metal carrying an electrocatalytically active coating of a mixture of (1) an oxide of titanium and (2) ruthenium oxide, said process comprising treating the said anode with sulphuric acid containing not more than 10 percent by weight of water thereby removing the scale without removing the active coating.

2. A process as claimed in claim 1 wherein the sulphuric acid contains up to 100 percent by weight of $H_2SO_4$.

3. A process as claimed in claim 2 wherein the sulphuric acid contains 94 to 98 percent by weight of $H_2SO_4$.

4. A process as claimed in claim 1 wherein the treatment with sulphuric acid is carried out at ambient temperature.

5. A process as claimed in claim 1 wherein the barium containing scale is produced in the electrolysis of an aqueous solution of an alkali metal chloride, which prior to the said electrolysis had been subjected to a purification stage including the removal of sulphate ions therefore by the addition of barium chloride.

6. A process as claimed in claim 5 wherein the alkali metal chloride is potassium chloride.

7. A process as claimed in claim 1 wherein the film-forming metal is titanium.

8. A process as claimed in claim 1 wherein the coating comprises at least one platinum group metal or an oxide thereof.

9. A method of cleaning an electrode of the kind having a substrate of titanium and an electrocatalytically active coating which coating comprises titanium oxide and ruthenium oxide, said electrode having an exterior scale which contains barium sulphate, said method comprising treating the electrode with sulphuric acid containing not more than 10 percent by weight for a period of time sufficient to remove the scale without removing said active coating.

10. A method as in claim 9 wherein the electrode is immersed in the sulphuric acid at ambient temperature for a period of 10 to 30 minutes.

11. The process of claim 1, wherein the electrode is immersed in the sulphuric acid at ambient temperature for a period of 10 to 30 minutes.

* * * * *